United States Patent [19]

Williams

[11] 4,406,639

[45] Sep. 27, 1983

[54] WET PROCESSING OF ELECTRODES OF A CRT TO SUPPRESS AFTERGLOW

[75] Inventor: Robert H. Williams, Scranton, Pa.

[73] Assignee: RCA Corporation, New York, N.Y.

[21] Appl. No.: 306,713

[22] Filed: Sep. 29, 1981

[51] Int. Cl.[3] ..... H01J 9/02

[52] U.S. Cl. ..... 445/59; 134/2; 445/34

[58] Field of Search ..... 445/59, 2, 1, 34; 134/2, 26

[56] References Cited

U.S. PATENT DOCUMENTS

| | | | |
|---|---|---|---|
| 1,353,654 | 9/1920 | Harrison | 134/2 |
| 3,233,954 | 4/1963 | Bailey et al. | 445/59 |
| 3,556,627 | 4/1967 | Takemoto | 445/59 |
| 4,049,471 | 9/1977 | Koontz | 134/2 X |
| 4,217,521 | 8/1980 | Dietch et al. | 313/479 |

*Primary Examiner*—Kenneth J. Ramsey

*Attorney, Agent, or Firm*—E. M. Whitacre; D. H. Irlbeck; L. Greenspan

[57] ABSTRACT

In the novel method, before an electron-gun mount assembly is sealed into the neck of a CRT, at least the high-voltage electrodes and the adjacent portions of the focus electrodes are dipped into an aqueous solution consisting essentially of hydrogen peroxide and water. The solution contains substantially more than 10, and preferably about 30 to 50, weight percent of hydrogen peroxide.

6 Claims, 2 Drawing Figures

WET PROCESSING OF ELECTRODES OF A CRT TO SUPPRESS AFTERGLOW

BACKGROUND OF THE INVENTION

This invention relates to a novel method of processing of electrodes of the electron-gun mount assembly of a CRT (cathode-ray tube) to suppress afterglow during the subsequent operation of the CRT.

A CRT comprises an evacuated envelope which includes a neck, a funnel and a faceplate opposite the neck. A viewing screen is supported on the inner surface of the faceplate. A conductive coating supported on the inside surface of the funnel constitutes one plate of a filter capacitor and is the anode of the CRT. A conductive coating on the outside of the funnel constitutes the other plate of the filter capacitor. An electron-gun mount assembly, including one or more electron guns supported from a glass stem, is sealed into the neck of the envelope. Each electron gun includes a cathode and a plurality of electrodes including a final high-voltage electrode and a focus electrode spaced from the high-voltage electrode. After the mount assembly is sealed into the neck, the CRT is baked at about 300° to 450° C. and is simultaneously exhausted of gases to a relatively low pressure below $10^{-4}$ torr. Then, the CRT is tipped off; that is, the CRT is sealed. After tipping off, the mount assembly is subjected to electrical processing so that the electron guns become operative, spurious electron emission therefrom is reduced and their operation is stabilized.

A completed CRT, installed in a chassis and operated in a normal manner, may continue to emit light from the viewing screen after the normal operating voltages are removed from the mount assembly. This effect, which may linger for minutes or hours, is referred to as "afterglow" and is attributed to the coincidence of two factors. First, a large residual electrostatic charge remains on the filter capacitor (which is integral with the CRT) after the operating voltages are removed, and therefore a residual high voltage remains on the anode of the CRT and the high-voltage electrodes of the mount assembly with respect to the other electrodes of the mount assembly. Second, there are sites on the electrodes of the electron gun from which electrons can be emitted when they are under the influence of the electric field produced by the residual charge on the filter capacitor. Emitted electrons under the influence of the electric field are directed toward, and impinged upon, the viewing screen producing the afterglow.

It has been suggested previously that dipping the electrodes of the mount assembly in liquid air or a similar volatile liquid will induce localized turbulance in the liquid and thereby remove particles from the electrodes. It has also been suggested that dipping the electrodes of the mount assembly in an acid etching solution, which may contain hydrogen peroxide, for a sufficient time will remove oxidized layers that may have formed on the surfaces of the electrodes. These prior procedures are said to reduce arcing around the mount assembly during the operation of the CRT by reducing field emission. In both cases, material is removed from the surfaces of the electrodes.

SUMMARY OF THE INVENTION

The novel method follows the prior methods of assembly except that, after the mount assembly is assembled and before it is sealed into the neck of the CRT, at least the high-voltage electrodes and the adjacent focus electrodes of the mount assembly, but not the cathode, are dipped into an aqueous solution consisting essentially of hydrogen peroxide and water. The solution contains substantially more than 10, and preferably about 30 to 50, weight percent of hydrogen peroxide. The electrodes are then rinsed in water and dried.

It is believed that the effect of the novel method is to reconstitute and/or reinforce the thin oxidized layers that normally are present on the surfaces of the electrodes. The novel method thereby reduces the number and efficiency of electron-emitting sites on the electrodes. The novel method does not remove material, and particularly oxides, from the surfaces of the electrodes as is done by the previously-suggested procedures.

DETAILED DESCRIPTION OF THE PREFERRED EMBODIMENT

Figure 1:
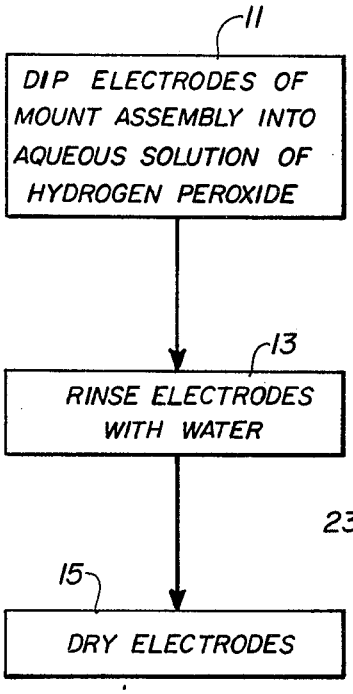
FIG. 1 is a process flow chart illustrating generally the steps in the novel method.

The novel method is illustrated generally by the process flow chart of FIG. 1. In the usual sequence of manufacture, the electrodes of a mount assembly are assembled on a mandrel, and then at least two glass support rods are attached to the electrodes, producing a self-supporting, unitary "partial mount assembly." Then, the cathode is precisely positioned in the partial mount assembly. Then, a stem with leads extending therethrough is attached to the electrodes. Then, the convergence cup is attached to the assembly, producing the "complete mount assembly."

In the first step of the novel method, selected ones of the electrodes are dipped into an aqueous solution of hydrogen peroxide as shown by the box 11. The solution is quiescent and contains more than 10% hydrogen peroxide and preferably about 30 to 50% hydrogen peroxide. Besides hydrogen peroxide and water, no other compound need be present in the solution. The solution is essentially free of oxide-dissolving compounds. The dipping time need be only a few seconds, although the electrodes may remain in the solution longer with no adverse effects. Generally, the electrodes remain in the solution for less than 60 seconds. Of course, the surfaces of the electrodes of interest should be clean, especially free from oily, greasy, or other hydrophobic material. The dip can be carried on the partial mount assembly before the cathodes are inserted or at any other stage thereafter up to, but not including, the step of sealing the mount assembly into the neck of the CRT.

After dipping the electrodes into the hydrogen peroxide solution, the electrodes are dipped or rinsed in deionized water as shown by the box 13 and then dried in air with or without the assistance of heat as shown in the box 15.

As a first example, the novel method is applied in the manufacture of an in-line electron-gun mount assembly, such as the mount assembly disclosed in U.S. application Ser. No. 078,134 filed Sept. 24, 1979 by R. H. Hughes et al. However, the novel method may be applied to advantage to any bipotential or tripotential electron-gun mount assembly.

Figure 2:
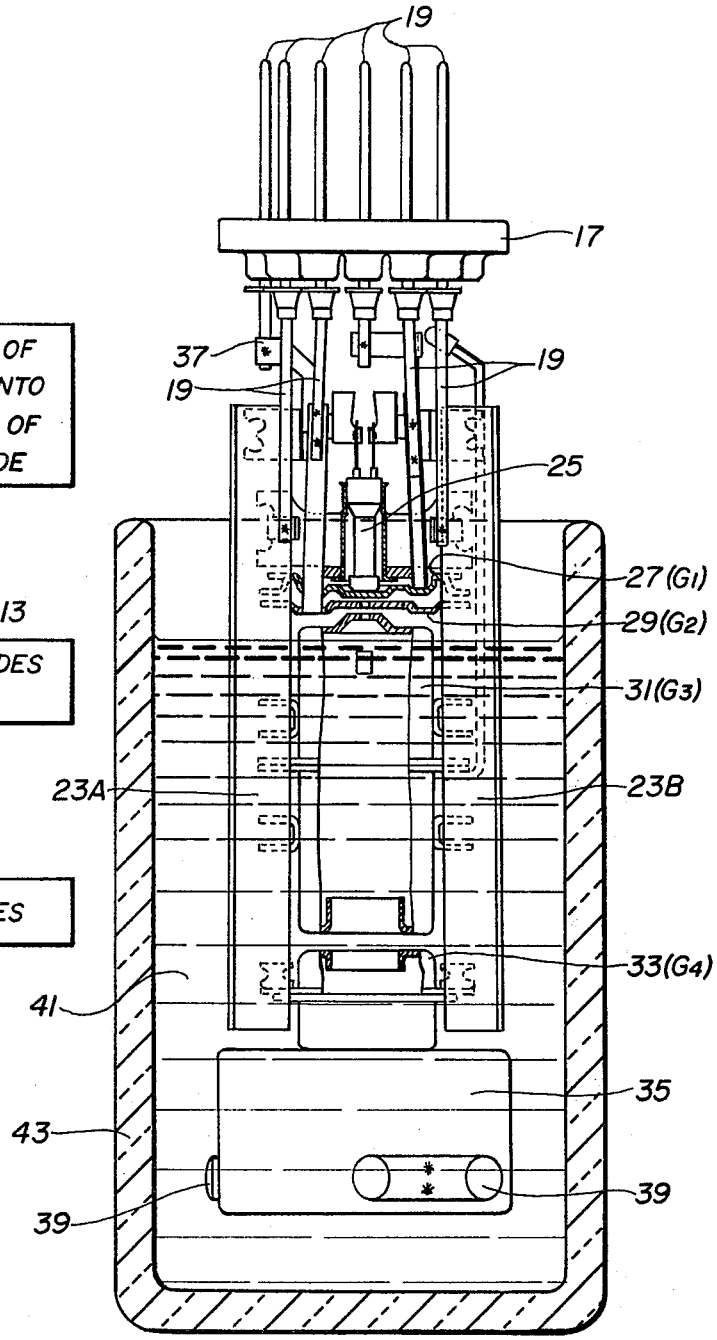
FIG. 2 is a partially-sectional elevational view of an electron-gun mount assembly immersed in a solution of hydrogen peroxide during a preferred embodiment of the novel method.

As shown in FIG. 2, the complete mount assembly includes a glass stem 17 having a plurality of metal leads or pins 19 extending therethrough. This mount assembly comprises three in-line electron guns and is designed to generate and project three electron beams along coplanar convergent paths in a CRT. The mount assembly comprises first and second glass support rods or beads 23A and 23B respectively from which the various electrodes are supported to form a coherent unit in a manner commonly used in the art. These electrodes include three substantially equally transversely spaced coplanar cathodes housed in cathode sleeves 25 (one for producing each beam), a control-grid electrode (also referred to as G1) 27, a screen grid electrode (also referred to as G2) 29, a first accelerating and focusing electrode (also referred to as G3) 31, a high-voltage electrode (also referred to as G4) 33, and a shield cup 35, longitudinally spaced in that order by the beads 23A and 23B. The various electrodes of the mount assembly 21 are electrically connected to the pins 19 either directly or through metal ribbons 37. The mount assembly includes a plurality of snubbers 39 which position the shield cup 35 when the mount assembly is sealed into the neck of a CRT, and make electrical contact to the internal conductive funnel coating (not shown).

An aqueous solution 41 consisting essentially of about 30 weight percent hydrogen peroxide ($H_2O_2$) is held in a glass or plastic container 43. The mount assembly is slid into the solution 41, shield-cup 35 first, to immerse all of the high-voltage electrode 33 and most of the focus electrode 31, as shown in FIG. 2. All of the focus electrode 31, the screen electrode 29 and the control electrode 27 may also be immersed. However, it does not appear to be advantageous to do this, and there is a danger of splashing the cathode, which may adversely affect its performance. The dip is continued for about 10 seconds, and then the mount assembly is withdrawn. Since the dipped electrodes 31 and 33 are hollow, the solution 41 rises in, and then drains from, both the insides and outsides of the electrodes. Then, the mount assembly is dipped into deionized water up to the same level as for the solution 41 and then withdrawn. After the water has drained, the mount assembly is dried in air at about 120° C. to remove residual water and hydrogen peroxide.

As a second example, the first example is repeated except that a 50 weight percent aqueous solution of hydrogen peroxide is substituted for the 30 weight percent solution.

As a further alternative, the mount or a plurality of mounts may be held in a rack in the container. The hydrogen-peroxide solution is pumped into the container from below and rises to a desired level. Then, the solution is drained out. This method reduces the chance of splashing the cathodes. In both methods, the solution is essentially quiescent to avoid splashing the cathodes.

The hydrogen peroxide solution 41 may be used for treating successive mount assemblies. It has been found desirable to replace a particular solution with new solution after about 2,500 mount assemblies have been dipped therein. It is not known what chemical reaction or chemical products are produced on the electrode surfaces by the novel method. However, it is known that the extinction voltage for afterglow is increased substantially by the novel method and that afterglow is substantially reduced thereby. It is believed that the solution, with its high concentration of hydrogen peroxide (a known oxidizing agent), reconstitutes and/or reinforces the oxidized layers that are normally present on the surfaces of the electrodes. Oxides and oxidized layers of metals usually have higher work functions than the metals on which they reside. The presence of reinforced oxidized layers on the electrodes may reduce field emission from these surfaces.

To test for afterglow, the mount assembly is assembled into a CRT, and the CRT is completed and rendered operative. The test is conducted in a darkened room. All of the electrodes of the CRT are grounded except for the high-voltage electrode and the anode. The anode voltage is increased until some portion of the viewing screen is excited to luminescence as viewed with the human eye. Only a localized area need light up, and the area may differ for different tubes. Then, the anode voltage is slowly reduced until all luminescence of the screen just disappears. The anode voltage at which all luminescence disappears is called the extinction voltage or $E_{ext}$.

It is preferred that the extinction voltage have a high value and, generally speaking, as high a value as possible. It is preferred that the extinction voltage is greater than the operating anode voltage of the CRT. Generally, tubes treated by the novel method exhibit extinction voltages that are about 2 to 10 kv higher than similar tubes with mounts not treated by the novel method, but are otherwise the same.

In one series of experiments with 25 V 100° tripotential mounts, six CRTs with mounts that had been dipped as described above in a 30 weight percent hydrogen peroxide solution had an average $E_{ext}$ of about 28.75 kv; whereas six CRTs with similar mounts that had not been so dipped but were otherwise similarly treated had an average $E_{ext}$ of about 23.72 kv.

In another series of experiments, twelve 25 V 100° CRTs with hydrogen-peroxide-treated mounts exhibited an average $E_{ext}$ of about 33.6 kv; whereas nine similar CRTs with untreated mounts had an average $E_{ext}$ of about 23.9 kv.

What is claimed is:

1. In a method of making a CRT comprising an evacuated envelope and, located within said envelope, a unitary mount assembly comprising a plurality of electrodes including a final high-voltage electrode and a focus electrode spaced from said final high-voltage electrode, said method including assembling said mount assembly and sealing said mount assembly into said envelope, the improvement comprising, prior to sealing said mount assembly into said envelope, dipping at least said high-voltage electrode and the adjacent portions of said focus electrode into an aqueous solution consisting essentially of hydrogen peroxide and water, rinsing said dipped electrodes with water and then drying said dipped electrodes.

2. The method defined in claim 1 wherein said solution contains substantially more than 10 weight percent hydrogen peroxide.

3. The method defined in claim 1 wherein said solution contains about 30 to 50 weight percent hydrogen peroxide.

4. The method defined in claim 3 wherein said solution is essentially free of oxide-dissolving compounds.

5. The method defined in claim 3 wherein said solution is essentially quiescent during said dipping step.

6. The method defined in claim 3 wherein, during said dipping step, said electrodes remain in said solution for a time interval of less than 60 seconds.

* * * * *